US007828593B2

(12) United States Patent
Gilliam

(10) Patent No.: US 7,828,593 B2
(45) Date of Patent: Nov. 9, 2010

(54) SHIELDED OILFIELD ELECTRIC CONNECTOR

(76) Inventor: Charles David Gilliam, 19423 Indian Ridge Ave., Baton Rouge, LA (US) 70817

( * ) Notice: Subject to any disclaimer, the term of this patent is extended or adjusted under 35 U.S.C. 154(b) by 148 days.

(21) Appl. No.: 12/151,099

(22) Filed: May 2, 2008

(65) Prior Publication Data

US 2009/0275234 A1 Nov. 5, 2009

(51) Int. Cl.
*H01R 13/648* (2006.01)

(52) U.S. Cl. ..... 439/578; 439/607.41

(58) Field of Classification Search ..... 439/578, 439/607.41, 583

See application file for complete search history.

(56) References Cited

U.S. PATENT DOCUMENTS 3,783,434 A * 1/1974 Ransford, III ..... 439/281
5,174,769 A * 12/1992 Dearman ..... 439/98
5,269,701 A * 12/1993 Leibfried, Jr. ..... 439/578
6,692,299 B1 * 2/2004 Stockmaster ..... 439/578
7,335,059 B2 * 2/2008 Vaccaro ..... 439/578
7,442,096 B1 * 10/2008 Gilliam ..... 439/825
7,465,190 B2 * 12/2008 Henningsen ..... 439/578
7,566,243 B1 * 7/2009 Hung ..... 439/578

* cited by examiner

*Primary Examiner*—Gary F. Paumen
(74) *Attorney, Agent, or Firm*—Roy Kiesel, et al

(57) ABSTRACT

A high-power, shielded, single-pole electrical connector and method for installing such a connector are disclosed. The connector has a single-pole connector housed within an electrically conductive outer shell. The inner, single-pole connector is electrically insulated from the outer shell. A shielding trap is used to provide electrical contact between the outer shell of the connector and a shielding layer of a shielded electrical supply cable. The inner, single-pole connector may be a male-female type or a lug-type. If a lug-type single-pole connector is used, a dual-shell, cylindrical insulator may be used to provide access to the lug bolts. Such an insulator may be realigned after the lug-bolt access is no longer required so that a complete insulating barrier is provided around the lug-type connector. A variable-angle, lug-type connector may be used.

10 Claims, 8 Drawing Sheets

SHIELDED OILFIELD ELECTRIC CONNECTOR

FIELD OF THE INVENTION

The invention relates to a shielded, single-pole electrical connector for use in high-power applications. The invention is particularly suited for use with high-power variable frequency AC drive motors.

CROSS-REFERENCES

Pending patent application Ser. No. 12/015,661, which is co-owned with the current application, is hereby incorporated by reference.

BACKGROUND OF THE INVENTION

AC motors spin at a speed determined by the number of poles and the frequency of the applied AC current. The speed in revolutions per minute (RPM) is equal to 120×frequency (Hz) divided by the number of poles. For example, a motor with four poles operating at 60 Hz, would have a nominal speed of 1800 rpm. The operating speed of traditional AC motors is relatively constant, though in practice, the loaded speed does vary.

The rotational speed of DC motors, on the other hand, varies with supply voltage. By reversing the polarity of the supply voltage, a DC motor will reverse direction. Speed control, therefore, is a fairly simple matter with DC motors. When speed control is important, and the ability to reverse the direction of rotation is also needed, DC motors provide one effective option.

The oil industry is one area where high-power rotational motors with reliable speed control are used. An oil well is drilled by rotating a drill string with a drill bit at its end. Today, it is common for a variety of exploration tools to be mounting in the drill string, typically near the drill bit. These tools measure temperature, pressure, density of the formation, resistivity or conductivity of the formation, and various other parameters of interest to oilfield exploration engineers.

In an oilfield drilling operation, it is desirable to control the speed of the drill motor. This can be important for optimum effectiveness of the drilling bit, for removal of cuttings, and for the operation of tools installed in the drill string. Large DC motors traditionally have been used in the oilfield for this purpose. These motors are not very efficient, but they do provide reasonably good control of the rotational speed of the drill string. These motors also provide high torque, which is crucial in this industrial setting.

Variable frequency drive (VFD) AC motors have become increasingly popular in recent years, including in the oilfield industry. VFD motors are a good alternative to DC motors, in large part because the VFD motors are more efficient. Improvements in the technology in recent years have made large VFD motors a reliable, efficient option in many heavy industries. The oilfield industry has been opting for large VFD motors more and more in recent years.

To supply VFD motors, two conversions are done. First, the AC supply is converted to DC, and then the DC is converted to a variable frequency AC signal. In the most common arrangement, the variable frequency AC signal is made up of a series of DC pulses. Pulse width modulation of a DC output is used to create a simulated AC sine wave signal. The DC polarity is reversed to create the negative portion of the simulated sine wave.

This process involves a great deal of high speed switching. In high-power applications, the switching components may have to switch on and off thousands of times per second, and may rise and fall by hundreds of volts with each switch. This type of switching produces a great deal of harmonic and switching noise in the system. These noise components of the total signal will be carried by the conductors from the power supply to the motors.

The VFD noise can cause problems with electronic systems operated in the same physical area. Computer equipment can experience problems. Control and monitoring equipment also may experience problems due to the VFD noise. VFD motors offer important benefits, but the problems caused by the VFD noise must be controlled, or this problem may outweigh the benefits of a VFD system.

To limit the transmission of the noise signals, shielded power cables are typically used application were VFD noise poses a problem. Again, the oilfield industry provides a good example. During the oil drilling operation, computers and other electronic equipment are used to monitor and evaluate various parameters. VFD noise can cause serious problems in the oil drilling situation if it is not controlled. Shielded power cables are often used for this reason in oilfield applications where VFD motors are used.

A typical shielded cable application in the oilfield might involve use of single, shielded power cables running from the VFD power supply to the VFD motor. The cables are hard-wired at each end, so no separate inline connectors are used. The shielding is grounded at one or both ends of the run. The internal, shielded, power conductor supplies the VFD current to the VFD motor. The continuous run of shielding on the power cable contains most of the potentially harmful VFD noise.

This typical arrangement will not work, however, if a connection is needed somewhere between the supply and the drive motor, or at either end of the power cable. For example, if the run from the VFD power supply to the VFD motor is too long for a single cable, it is necessary to use some type of inline connector to piece together the different sections of shielded cable. This may be a fairly common situation because the shielded cable used in oilfield and other heavy industries tends to be quite large and heavy. Such cable may weigh several pounds per foot, making long cable runs quite heavy and unwieldy. Using shorter sections of cable connected together with separate connectors is one way of addressing this problem.

Cable connections also may be needed at the VFD motor or at the supply. Use of a connector at these points allows for easier replacement of a cable, when compared to a hard-wired arrangement. In oilfield drilling operations, the drive motor may be moved up and down during the drilling process. The drive motor may also need to be moved to another position for service or inspection. With so much movement, the connections between the cable and the drive motor will be subject to stress and may fail after extended use. In addition, if the drive motor is to be moved for inspection or service, there may be a need to disconnect the drive motor from its supply cables. These connection and disconnection operations are much easier to accomplish is a separate connector is used, as opposed to hard-wiring the supply cables to the drive motor.

If a nonshielded connector is used, some of the noise found in the VFD power lines will be transmitted to various items that may be damaged by such noise. Computers and other electronic equipment may be vulnerable to such damage. It is, therefore, highly desirable to ensure than the entire electrical path from the VFD power supply to the VFD motor, including all connections, is fully shielded. Shielded power cables are relatively easy to find, but there remains a need for high-power shielded connectors.

The need for an inline or end-of-cable connector in high-power VFD applications poses a problem. Low power shielded cable connectors are well known. Such connectors are used widely on home cable television and Internet systems. The small, shielded connectors used in such applications provide a continuous shield for any noise that exists on the cable signal.

In a typical low power shielded connector, the cable has a small internal core conductor that carried the signal of interest. An insulator surrounds the core conductor, and a braided shield surrounds the core insulator. Another insulator, typically the outer covering of the cable, is positioned over the braided shield wires. The shielded connector connects the braided shield wires to the outer shell of the connector and connects the core conductors while providing an insulation layer between the core conductors and the shell of the connector. In this manner, a continuous electrical path is provided for both the core conductor and the braided shield, with these two paths being electrically insulated from each other.

The same concept is possible, and needed, in the high-power VFD motor context. It is, however, a huge step to go from the small, shielded connectors used with home cable television systems to the sort of shielded connector needed for a high-power VFD situation. The core conductor in a home television cable is not much larger than a piece of thread or fishing line. The cable is light, the shielding is very thin and easily handled. The current capacity of these systems, and the connectors used with these systems, is quite low.

In an oilfield VFD application, on the other hand, the cables can weigh hundreds of pounds. The core power conductors can be an inch thick or more and are very stiff. The shielding used in these high-power applications is much heavier and harder to work with than the thin shielding braid found on a home television cable. Cutting, crimping, and other typical tasks associated with making up electrical connectors all take on a very different nature when large, high-power cables are involved.

One particular challenge found in the high-power VFD application that is not present with low power cable television connectors is the difficulty in making up nearly identical connections repeatedly. Given the size, weight, and stiffness of the large power cables involved in high-power VFD applications, it is not practical to use a connector that requires precise and consistent positioning of all the connections between the connector and the supply cable. It is, therefore, highly desirable for a high-power VFD connector to allow for some variance in the positioning of the connections involved, while still providing a reliable, fully shielded connector.

Because the supply cable used in high-power VFD applications is so heavy and stiff, it is almost impossible to make up a connection with such cable if a quick turn or change of direction is required. Consider, for example, a connection made in a physical space where the supply cable must turn 45° immediately after the point of connection. It may not be possible to bend the cable to create this sharp a turn. There is a need, therefore, for a connector that solves this problem by allowing for use of heavy, shielded power cables, while providing the ability to make sharp bends or turns.

Finally, it is desirable for this connector to have an internal insulator between the shielded shell of the connector and the internal power conductor. Such an insulator should allow for access to lug bolts while also providing the capability to fully isolate, electrically, the internal power conductor once the connection has been made up. The insulator should be reliable and easy to use.

The present invention provides the high-power shielded connector needed for use with high-power VFD motors and power supplies. In a preferred embodiment, the connector includes a high-power, single-pole electrical connector; an electrically conductive, generally cylindrical outer shell having an internal electrical contact region; an electrically insulating layer positioned between the single-pole connector and the electrically conductive outer shell; and, a generally cylindrical shielding trap configured to provide an electrical connection between a shielding material of a high-power, electrical cable and the internal electrical contact region of the electrically conductive outer shell.

The method of connecting a high-power, shielded electrical cable to the connector includes stripping the supply cable to expose its layers as follows: approximately 1.5 to 1.75 inches of a core conductor; approximately 0.75 to 1.25 inches of a core conductor insulation; and, approximately 0.25 to 0.75 inches of a shielding layer. A high-power, single-pole electrical connector is connected to the exposed portion of the core conductor. A shielding trap is connected to the exposed portion of the shielding layer, such that the core conductor insulation is positioned between the shielding trap and the high-power, single-pole electrical connector. An insulating barrier is positioned around at least a portion of the high-power, single-pole electrical connector; and, an electrically conductive outer shell is positioned over the insulating barrier, the high-power, single-pole electrical connector, and the shielding trap such that the shielding trap is in electrical contact with the outer shell and the outer shell is electrically isolated from the high-power, single-pole electrical connector.

DETAILED DESCRIPTION OF CERTAIN PREFERRED EMBODIMENTS OF THE INVENTION

Figure 1:
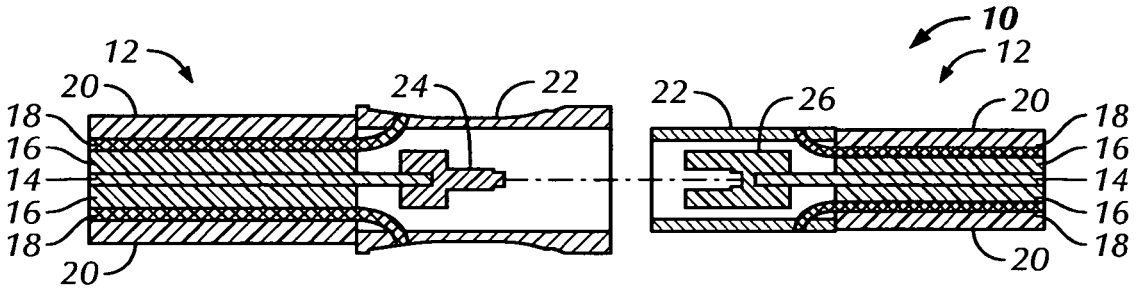
FIG. 1 is a conceptual cross-sectional drawing of a preferred embodiment of an inline connector in accordance with the present invention.

The present invention is best understood through reference to the accompanying drawings. FIG. 1 is a conceptual drawing of a high-power shielded connector 10. High-power shielded cables 12 are shown connected to male and female in-line versions of the connector 10.

Figure 2:
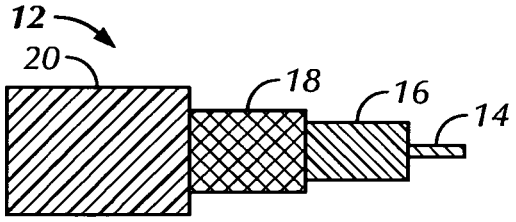
FIG. 2 is a side view of a power supply cable of the type often used with the present invention.

The parts of the cable 12 are shown in more detail in FIG. 2. A core conductor 14 makes up the center part of the cable 12. The core conductor 14 for high-power applications of the type for which the present invention is intended may be a single conductor or a twisted group of multiple conductors. The core conductor 14 should be capable of carrying up to 1,000 amps, or more. Such a conductor will be quite large, perhaps one inch in diameter or larger. A core conductor of this size and capacity is quite heavy and very stiff.

The next layer of the cable 12 is the core conductor insulation 16. This is a solid layer of electrically insulating material surrounding the core conductor 14. In the high-power applications, the insulator material must be chosen from a stable material that is not subject to breakdown at relatively high operating temperatures. With such high currents possible in the core conductor 14, considerable heat may be generated during use. The core conductor insulator 16 must be capable of withstanding high temperatures without breaking down.

The shielding 18 is the next layer of the cable 12. In high-power operations, the shielding is relatively heavy and stiff. Shielding may be braided or a solid layer, though braided shielding is believed to be more common. Either type works with the present invention. Some high-power shielded cables include a thin layer of Mylar or other similar material around the core conductor insulation 16. This type of configuration is not shown, and its use or nonuse is not material to the present invention. The shielding 18 is covered by the outer insulation 20. Another outer layer of highly durable material may be placed around the outer insulation 20, though the use of such material does not impact the performance of the present invention. Such materials, however, may be desirable to prevent excessive wear to the power cables in environments where such cables are subjected to considerable stress and wear.

When used with a preferred embodiment of the present invention, the core conductor 14 is stripped so that approximately 1⅝" of the conductor are bare. The core conductor insulation 16 is striped so that approximately 1" of it is exposed. About ½" of the shielding is exposed by the stripping process. This produces the "stair-step" cross-section shown in FIG. 2. The lengths of the different parts of the fully stripped cable are approximate, and variations of ⅛ to ¼ inch for any or all of the stated dimensions are not expected to alter the performance of the present invention.

Returning to FIG. 1, it can be seen that the outer insulation 20 buts up against the end of the connector 10. The shielding 18 extends into the interior of the connector 10 and is then electrically connected, or in electrical contact with, the outer shell 22 of the connector 10. This is shown conceptually in FIG. 1. The core conductor 14 coming into the connector 10 from the left side in FIG. 1 is connected to a male single pole connector 24, which is positioned inside an electrically conductive outer shell 22. The single pole connectors used with the present invention may be of a type disclosed in patent application Ser. No. 12/015,661, which is incorporated by reference into the present application. A connector of the type disclosed in the cited application may be connected to the end of the core conductor 14.

On the right side of FIG. 1, is a conceptual drawing of a female version of the connector 10. A female single pole conductor 26 is shown connected to the core conductor 14 of the power cable 12, and is positioned within an electrically conductive outer shell 22. The shielding 18 is connected to the outer shell 22, as was shown for the male version of the connector 10.

The conceptual drawing illustrates the key operational characteristics of the invention. Two distinct electrical paths are maintained through the connector, with the core conductor path being fully contained within the outer shielding path. Thus, the core conductor is fully surrounded by an electrical shield both in the cable 12 and in the connector 10. This is the key feature needed by a high-power, shielded connector. The connector 10 must provide a reliable, low-resistance electrical connection for high power lines that is fully shielded.

Given the size and stiffness of the high-power cables, it is difficult to make a shielded connector that is both functional (i.e., meets the functional needs described above) and user friendly. For example, if a shielded connector is designed so that the power cable connections must be made to precise tolerances, the connector will be of little use in the field.

The nature of the connection between the shielding 18 and the conductive outer shell 22 poses another challenge. The connector cannot be too large in diameter or it will be too unwieldy to be of practical use in the field. The power cables used in these high-power applications typically range from 1.5 to 2.5 inches in outside diameter. The connector 10, therefore, should be approximately 3-4 inches in diameter, at the most. If the connector 10 is much larger than that, its size will make it less practical.

Given these sizing constraints, and the stiffness of the cable, it is difficult, if not impossible, to use a fixed or permanent connection between the shielding 18 and the outer shell 22 of the connector 10. Once a single pole conductor is connected to the core conductor 14, the cable 12 is positioned within the outer shell 22. At this point, the outer shell 22 covers the entire length of the exposed shielding 18. To make a fixed or permanent connection between the shielding 18 and the outer shell 22 would require an operator to somehow work within the small space between the cable 12 and the outer shell 22. Given the size and stiffness of the cable 12, such an operation is simply not feasible.

Nor is it feasible to use a fixed internal contact within the outer shell 22. If this were done, the operator would have to strip the cable 12 to precise length requirements and the operator would still have to make up at least part of the connection between the shielding 18 and the outer shell 22 within the small space between the cable 12 and the shell 22.

The present invention solves these challenges by using a shielding trap 30, which is illustrated in FIGS. 3-6. The shielding trap 30, in a preferred embodiment, is made of two separate rings made of electrically conductive material. A single piece shield trap could be used, but is not shown. For example, recessed slots or grooves with screw-down clamps could be used to attach the shielding to a single piece shielding trap. The two-piece shielding trap 30 shown in the drawings is preferred, but a single-piece trap also would work with the present invention.

Figure 3:
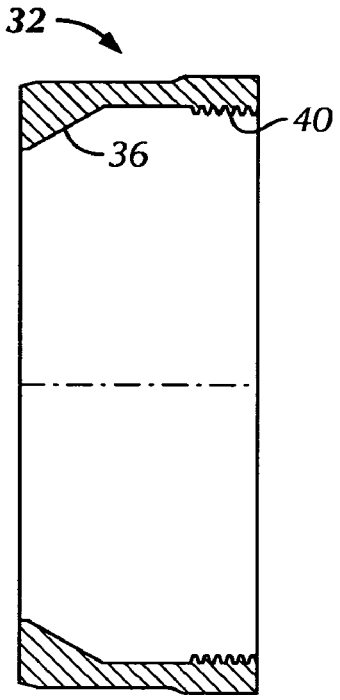
FIGS. 3 and 4 are side view, cross sections of two pieces of a shielding braid trap in accordance with the present invention.
Figure 4:
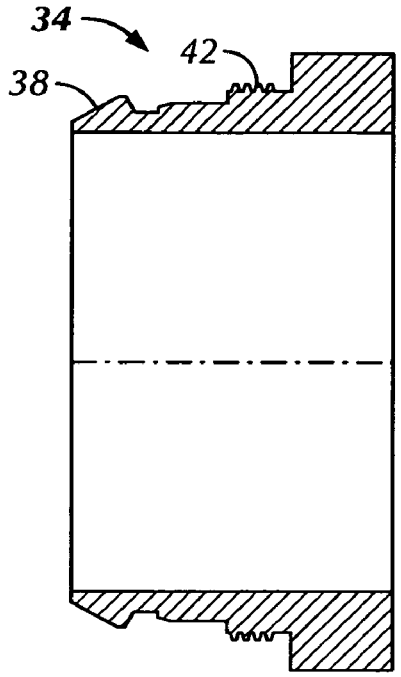
Figure 5:
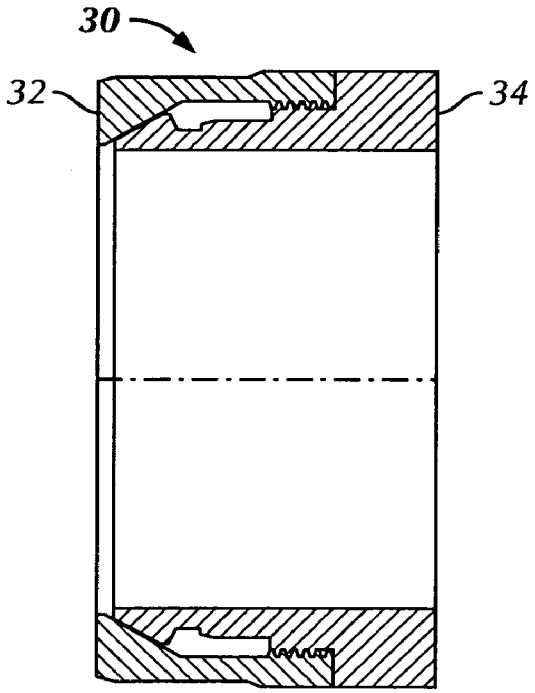
FIGS. 5 and 6 are side view, cross sections of a shielding trap in accordance with the present invention.

A first threaded ring 32 and a second threaded ring 34 are shown in FIGS. 3 and 4 respectively. The first threaded ring 32 has a first shielding contact surface 36 and a first set of threads 40. The second threaded ring 34 has a second shielding contact surface 38 and a second set of threads 42. These separate rings are threaded together to form the shielding trap 30, as shown in FIG. 5.

Figure 6:
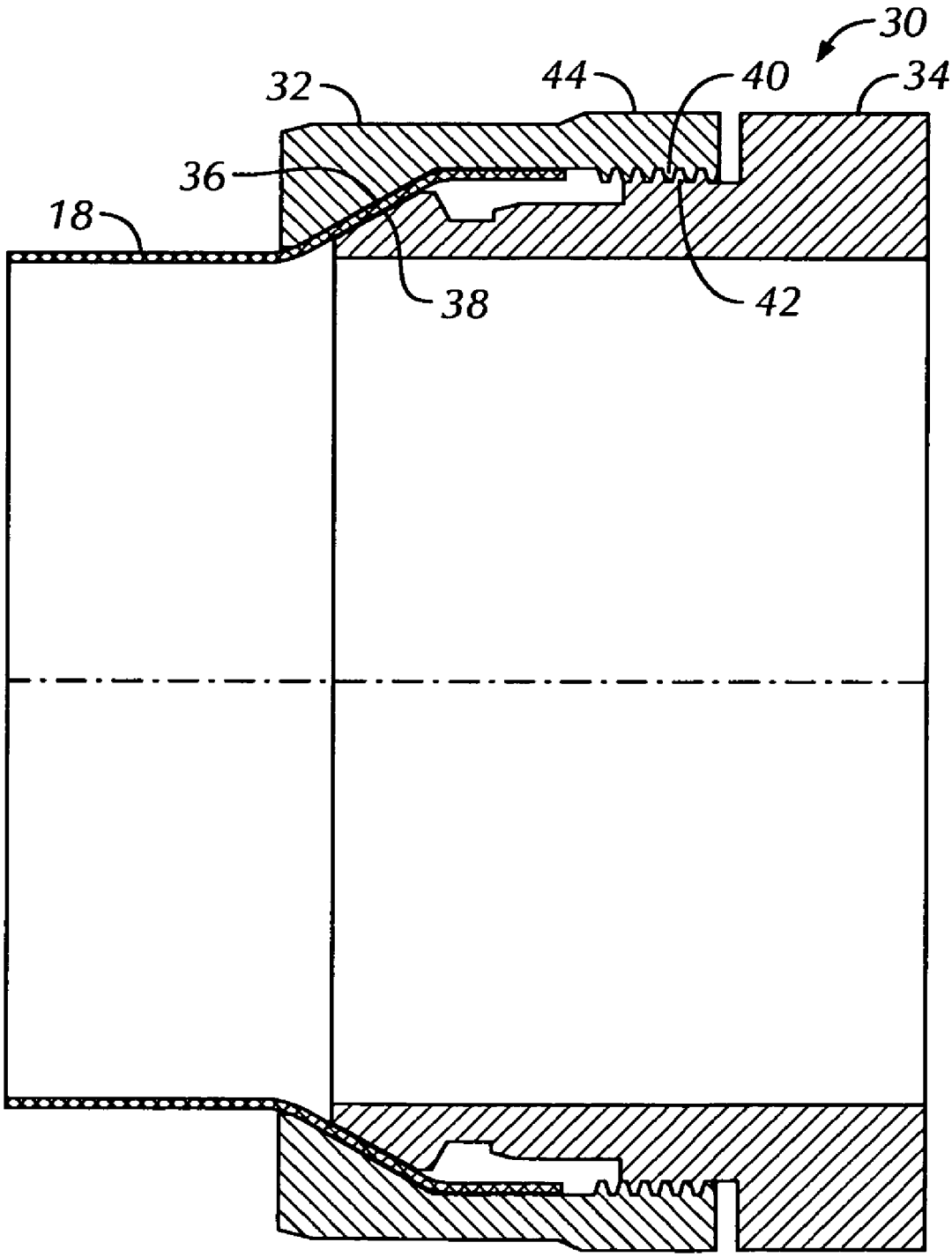

FIG. 6 shows how the shielding 18 is connected to the shielding trap 30. The shielding 18 is positioned between the first shielding contact surface 36 and the second shielding contact surface 38. The first threads 40 and second threads 42 are engaged and tightened. This action brings the two shielding contact surfaces into a compression fit against the shielding 18. This result provides a secure connection that will not pull out (i.e., is physically secure) and that provides good electrical conductivity.

A fully made-up shielding trap 30 is shown in FIG. 6. In actual use, the core conductor insulation 16 and the core conductor 14 would be concentrically within the shielding trap 30. That is, the inner two parts of the cable 12 would continue past the shield trap, extending farther into the connector 10. Enough of the core conductor insulation 16 should be exposed to ensure that this insulation layer extends beyond the entire length of the shielding trap 30. As shown in FIG. 6, this requirement means the core conductor insulation would extend past the second threaded ring 34. Outer contacts 44 are also shown. These contacts are better understood by reference to FIG. 7.

Figure 7:
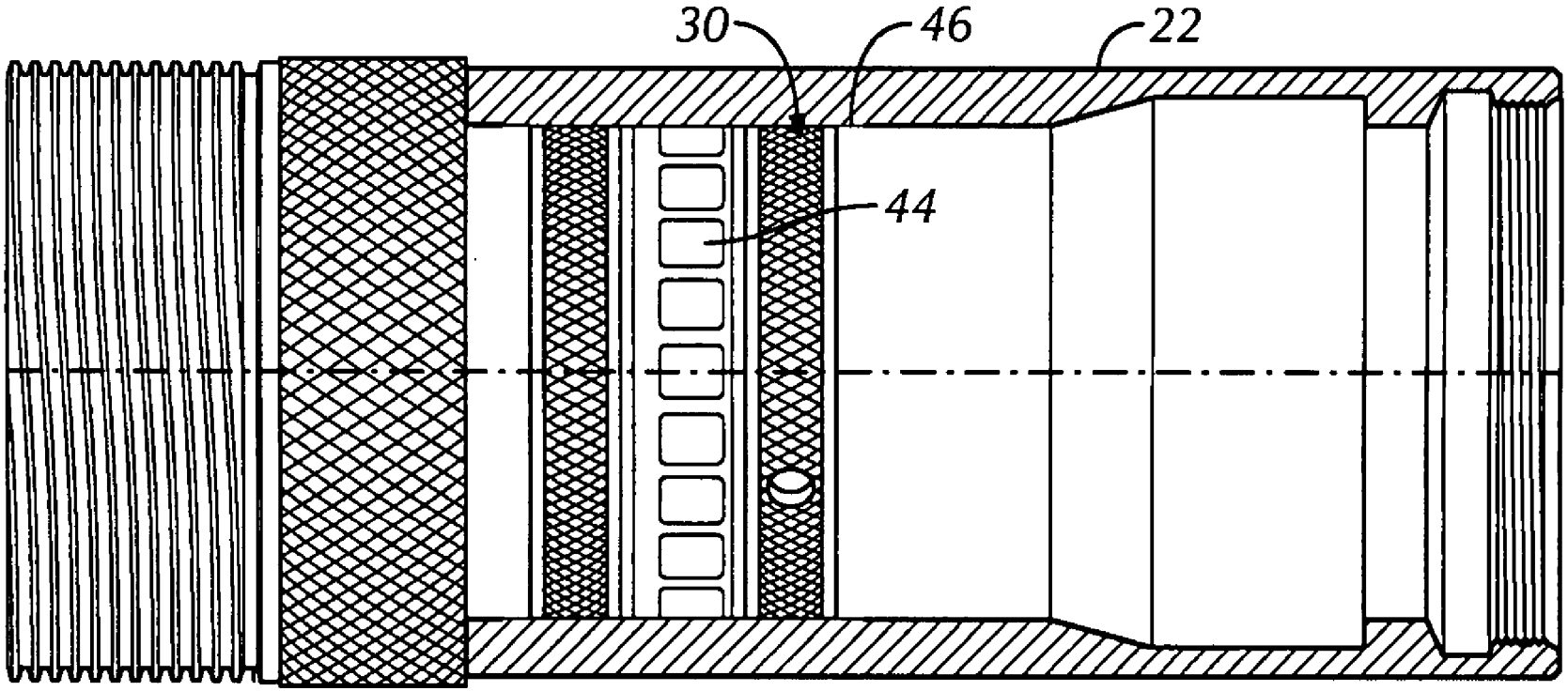
FIG. 7 is a cut-away view showing the outside of a shielding trap in accordance with the present invention.

In FIG. 7, a cut-away is shown of the portion of the connector 10 housing the shielding trap 30. The outer shell 22 is electrically conductive, but in practice may be coated with a material that greatly reduces the conductivity of its surfaces. Such a coating may be used for various reasons, including to reduce wear or corrosion. Corrosion resistance is a particular concern in offshore oilfield applications because of the salty environment.

In order to provide a good electrical connection between the shielding trap 30 and the outer shell 22, a contract region 46 is provided within the outer shell 22. This contact region 46 may be formed by machining away a very small layer of the shell 22, thus removing any coating material and exposing the more conductive material of the shell 22. The contact region 46 is sufficiently long to allow for some play in the positioning of the shielding trap 30. In a preferred embodiment, a contact region 46 of about ½ to ¾ inch is long enough to provide the needed play. A longer contact region 46 may be advantageous in some situations to provide ever greater tolerance for variations in the lengths of the stripped cable 12. This might be desirable when connectors are used in environments like the North Atlantic Sea or north of the Arctic Circle, where very low temperatures may make working with these types of materials even more difficult.

In FIG. 7, the shield trap 30 is shown with a series of outer contacts 44. These contacts may be a "finger" type of contact made of thin flaps of electrically conductive material that come into physical contact with the contract region 46 of the outer shell 22. By making such contact, an electrical path is established between the shielding 18 of the power cable 12 and the outer shell 22 of the connector 10. Because the shield trap 30 is connected to the cable 12 before the cable is positioned inside the outer shell 22, the connection is relatively easy to make. The contract region 46 is long enough so that the electrical connection is much less dependent upon the precise positioning of the shield trap 30 on the cable 12.

Figure 8:
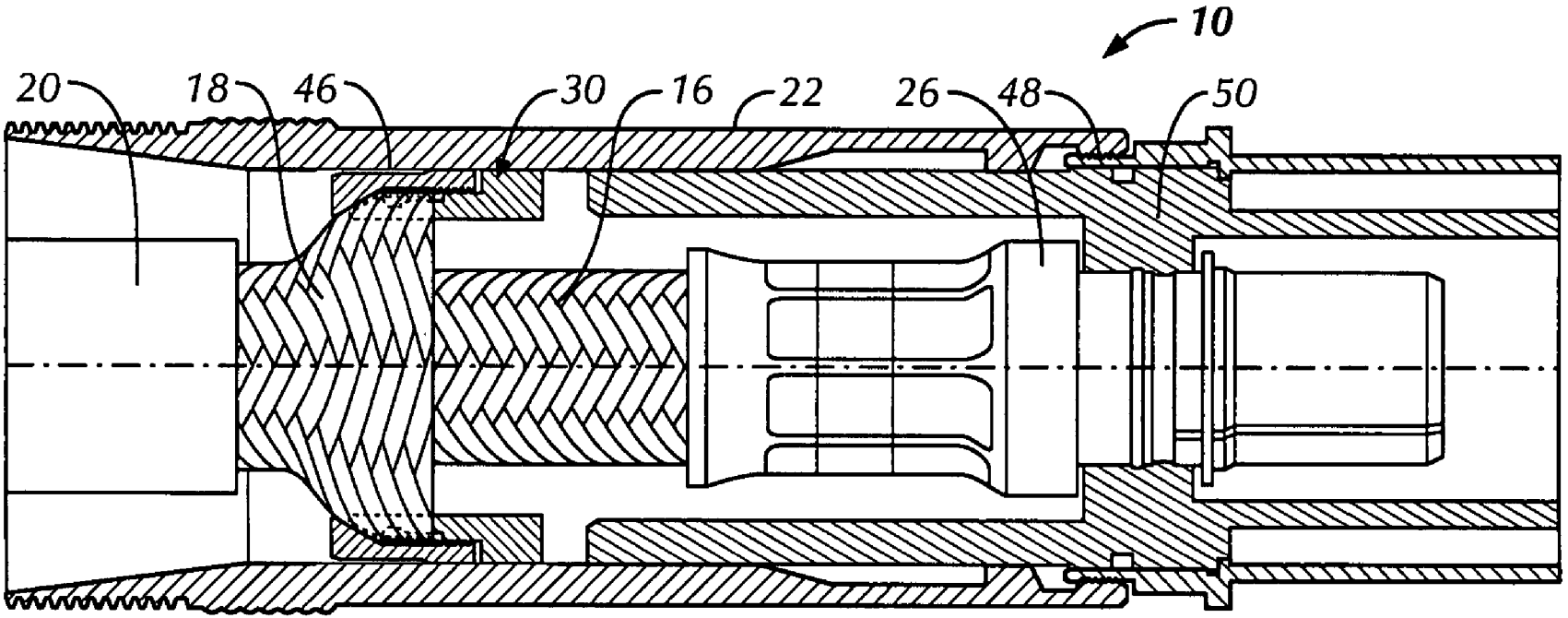
FIG. 8 is a cut-away view of a shielded connector in accordance with the present invention.

A cross-section of the connector 10 of the present invention is shown in FIG. 8. This figure shows a female version of an in-line connector in accordance with the present invention. The single pole female connector 26 is of the type disclosed in U.S. patent application Ser. No. 12/015,661, referenced above, though other types of single pole connectors may be used, as well. The core conductor 14 is crimped to the female single pole connector 26. The core conductor insulation 16 is shown between the female single pole conductor 26 and the shielding trap 30. As described above, the core conductor insulation 16 is exposed through stripping so that this insulation layer extends beyond the forward end of the shielding trap 30, where the forward end is in the direction of the female single pole connector 26 and away from the supply cable 12. The shielding trap 30 is connected to the shielding 18 as described above.

The method of assembling the connector can vary somewhat, but a preferred sequence follows. The cable 12 is stripped to leave the desired lengths of the various parts exposed. The shield trap 30 is then connected to the shielding 18. The female single pole connector 26 (as shown in FIG. 8; other types of single pole connectors also may be used) is then crimped to the core conductor 14. This assembly is then slid into the outer shell 22 of the connector 10.

In the embodiment shown in FIG. 8, the outer shell 22 of the connector 10 has two distinct parts. These parts may be joined through threads 48, which provide an electrically conductive path for the shielding. Alternatively, a conductive contact ring may be used to ensure a good electrical connection between different parts of the connector shell 22. FIG. 8 also shows the use of electrical insulation inside the connector 10, and between the single pole connector 26 and the outer shell 22. This insulation ensures the shielding path is electrically separate from the core conductor path.

In practice, a male version of the connector shown in FIG. 8 would be inserted into the illustrated female connector. The connection between the male and female connectors may be secured through use of additional threaded connections between the outer shells of the two connectors. For example, one of the two connectors may have an outer threaded ring that is configured to be threaded to matched threads on the other connector. This type of connection ensures both a good electrical connection for the shielding and a physically secure connection. The latter concern is very important in practice because of the very high power levels involved. An inadvertent disconnection during operation could be catastrophic.

Figure 9:
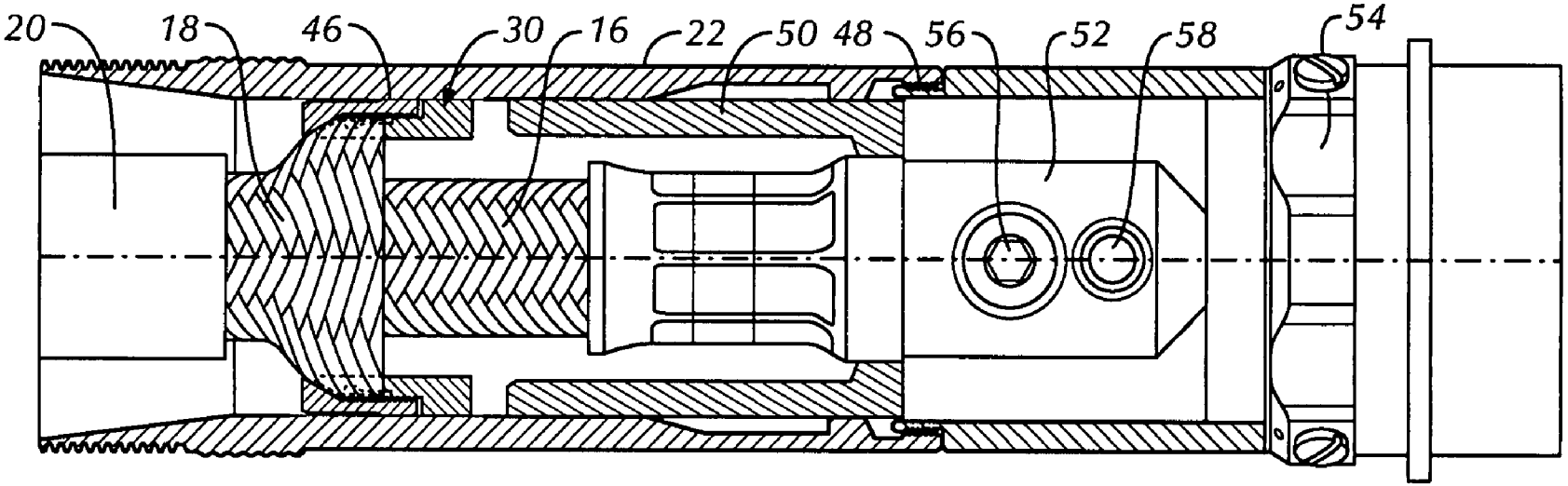
FIG. 9 is a cut-away view of an alternate embodiment of a shielded connector in accordance with the present invention.

FIG. 9 shows an alternative embodiment of the present invention with a lug-type single pole connector rather than a male/female type connector. A variable angle, single pole, lug connector 52 is shown inside the outer shell 22 of the connector. The shielding 18 is connected to the shielding trap 30 as described above, and is in electrical contact with the contact region 46 of the outer shell 22. The cable outer insulation 20 is shown at the cable end of the connector. Insulation 50 is positioned between the lug connector 52 and the outer shell 22. An optional cap 54 is also shown in FIG. 9. The cap 54 may be used to cover the end of the connector when it is not in use.

The lug connector 52 is secured to another connector or a contact using a first lug bolt 56 and a second lug bolt 58. An oversized, tapered hole is provided to accommodate the head of the lug bolt. To reduce the length of the lug connector 52, the lug bolt holes can be configured so that one lug bolt is started from each side of the connector. That configuration is shown in FIG. 9, where a larger hole is shown in connection with the first lug bolt 56, to indicate that the head of the first lug bolt 56 is started from the side of the connector shown in the drawing. The smaller hole shown with the second lug bolt 58 results from the fact that the second lug bolt 58 is started from the opposite side of the connector. This configuration allows for a shorter lug connector 52, and thus shortens the overall length of the connector.

When the lug bolt arrangement described above is used, it is necessary to access both sides of the lug connector to tighten or loosen both lug bolts. It is also necessary to provide insulation between the lug connector 52 and the outer shell 22. This poses a challenge, because if an access hole is provided in the insulator, then a gap in the insulation would exist at the access hole.

Figure 10:
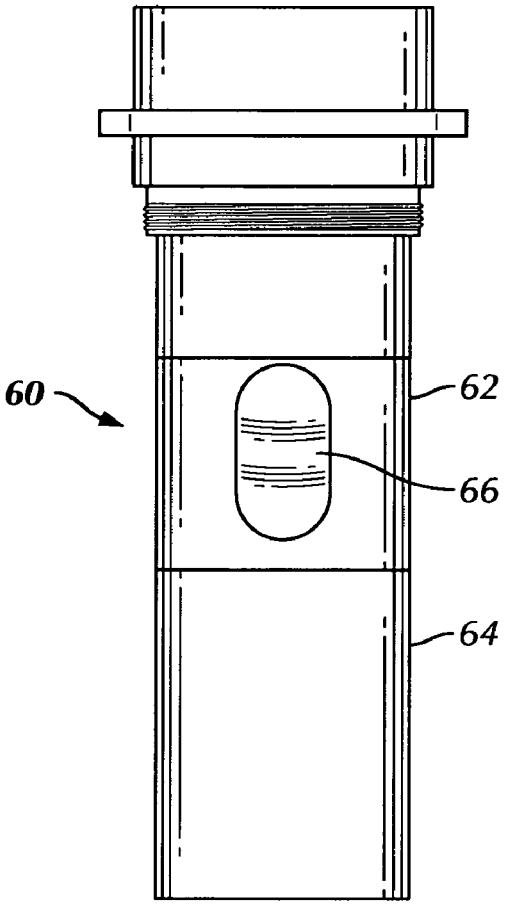
FIGS. 10 and 11 are side views of an insulator used with a single-pole lug connector in accordance with the present invention.
Figure 11:
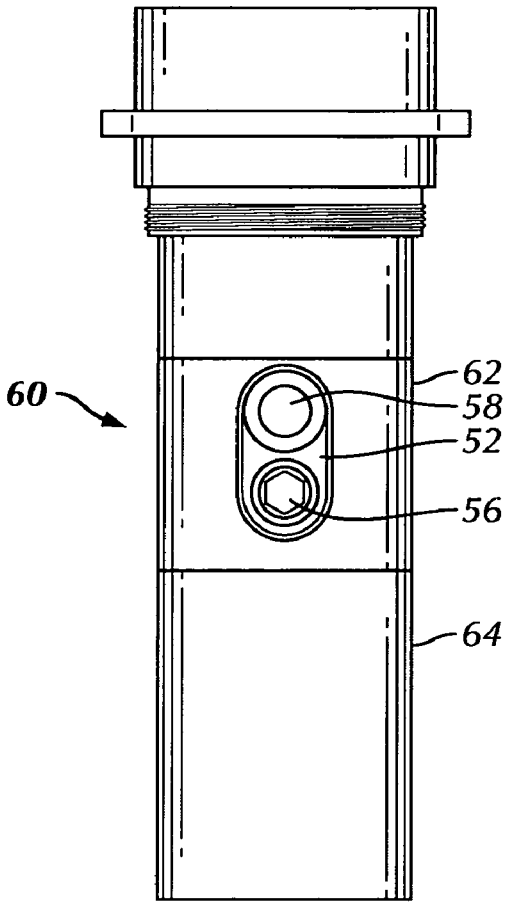

To solve this problem, the present invention utilizes a dual sleeve insulator 60, which is shown in FIGS. 10 and 11. The insulator 60 has a first cylindrical insulating shell 62 and a second cylindrical insulating shell 64. The second cylindrical insulating shell 64 extends along the full length of the insulator 60, with upper and lower sections shown in FIGS. 10 and 11. The middle portion of the second cylindrical insulating shell 64 has a reduced diameter, and the first cylindrical insulating shell 62 fits over the second shell 64 in this middle region, as shown in FIGS. 10 and 11. The two shells fit securely over the lug connector 52, but may be rotated together or separately around the lug connector 52.

Two oval access holes 66 are provided, one in each of the two cylindrical insulating shells. The two shells may be rotated relative to each other to align the access holes 66, as shown in FIG. 11, or to fully cover the lug connector, as shown in FIG. 10. This allows the shells to be used to provide access to the lug bolts when necessary, but also allows for a complete insulating barrier around the lug connector when access to the lug bolts is not required.

In operation, the insulator 60 is used as follows. The first cylindrical insulating shell 62 is rotated so that the oval access holes 66 are aligned with each other. Both insulating shells are then rotated together until the oval access holes 66 are positioned over one side of the lug bolts holes, as shown in FIG. 11. The first lug bolt 56 is then screwed into the lug bolt hole with the tapered, oversized opening. Once this lug bolt is tightened (partial tightening may be preferable at this stage), both cylindrical insulating shells are rotated together (i.e., to keep the oval access holes 66 in alignment) by 180° so that the oval access holes 66 are positioned over the opposite side of the lug connector 52. The second lug bolt 58 is then started in the second lug bolt hole. The cylindrical insulating shells may be rotated as necessary to tighten both of the lug bolts. Once the lug bolts are tight, the first cylindrical insulating shell 62 is rotated relative to the second cylindrical insulating shell 64 so that the insulator 60 provides a complete insulating barrier around the lug connector 52, as shown in FIG. 10. The outer shell 22 may then be positioned over the insulator 60 and the connection may be completed.

Figure 12:
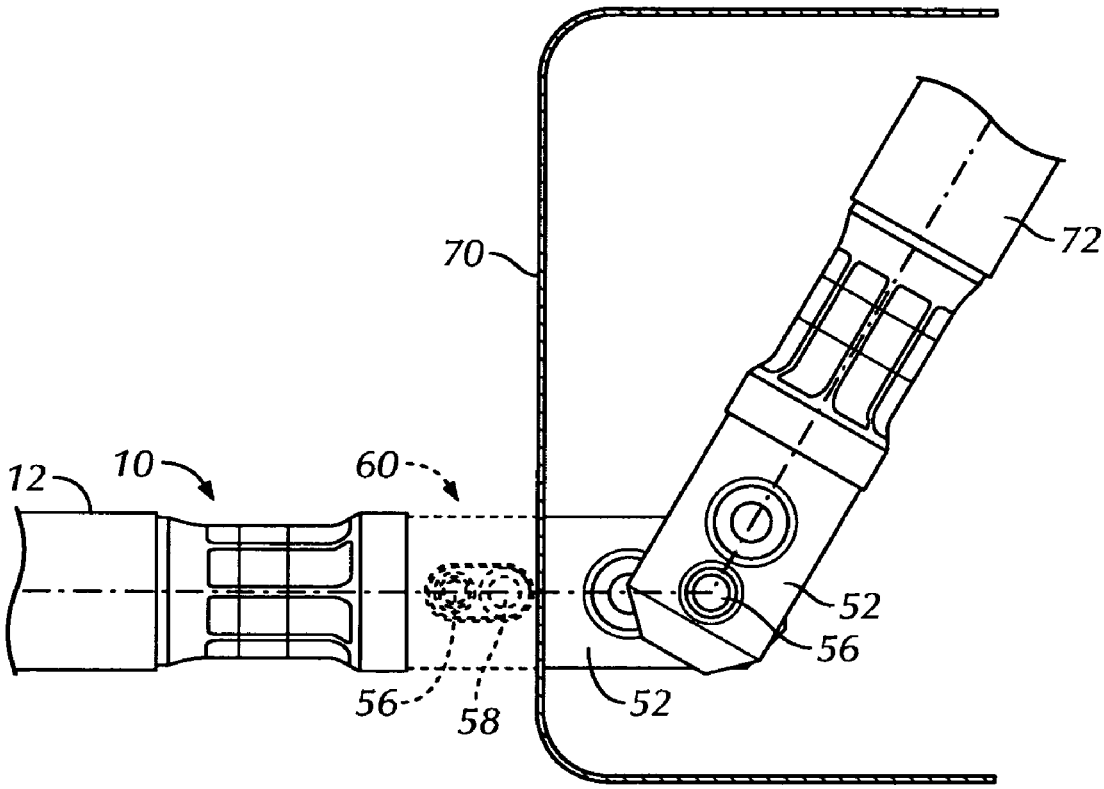
FIG. 12 is a conceptual, side-view drawing showing a lug insulator in accordance with the present invention and showing one lug connector at an approximately 45° angle.

The lug connector 52 also allows for angled connection, as shown in FIG. 12. A supply cable 12 is shown connected to a connector 10, which includes a lug connector 52, an insulator 60, and first and second lug bolts 56 and 58, respectively, all being of the same general configuration described above. These components are shown connected to a panel-mount lug connector, which is positioned on the casing of a VFD motor 70. The motor casing 70 provides shielding from noise within the motor, so that shielded cables and connectors are not needed within the casing.

It is possible, however, that a sharp bend or turn in the power line path may be needed inside the motor casing 70. This can be accomplished using the lug connector 52 and only a first lug bolt 56. The connector 52 can be positioned at almost any angle when connected in this manner, which provides desirable space saving within the casing of a motor or other component. Variable angle connections of this type are not possible when using the full connector 10, having the outer shell 22, as described above, but variable angle connections are feasible inside the casings of motors or other components. This is desirable because the need for an angled connection may be most common within motors or other components, rather than for in-line connectors.

The connector of the present invention allows for relatively easy and reliable installation in the field. The method of installing the connector 10 includes stripping the high-power electrical cable 12 to expose its inner layers, as shown in FIG. 2. In a preferred embodiment, the stripping results in the following lengths of the layers: approximately 1.625 (one and five-eighths) inches of core conductor is exposed; approximately one inch of the core conductor insulation is then exposed; and approximately 0.5 inch of the shielding layer is exposed. The first ring 32 of the shielding trap 30 is then slid over the cable 12 to the end of the exposed shielding 18. The shielding 18 is then lifted or pried away from the cable 12, so that the shielding 18 extends at an angle of about 45° from the longitudinal axis of the cable. The second ring 34 of the shielding trap 30 is then slid over the cable 12, and under the angled shielding 18. The first and second rings are then screwed together, creating a physically secure and electrically conductive connection between the shielding and the shielding trap.

A high-power, single-pole electrical connector is connected to the exposed part of the core conductor. This can be done before or after the shielding trap 30 is connected, but it may be simpler to connect the shielding trap first because of the added weight of the single-pole connector. The sequence is not critical, however, unless the single-pole connector has a larger outside diameter than the inside diameter of the first and second threaded rings of the shielding trap 30. If that is true, the shielding trap rings must be installed before the single-pole connector is connected.

When the shielding trap 30 and single-pole connector have been securely connected to the shielding 18 and the core conductor 14, respectively, an insulating barrier may be positioned over part or all of the single-pole connector. The outer shell 22 may then be positioned over the other parts of the connector.

While the preceding description is intended to provide an understanding of the present invention, it is to be understood that the present invention is not limited to the disclosed embodiments. To the contrary, the present invention is intended to cover modifications and variations on the structure and methods described above and all other equivalent arrangements that are within the scope and spirit of the following claims.

I claim:

1. A shielded electrical connector, comprising:

a. a single-pole electrical connector rated for currents of 200 amps or more and for voltages of 500 volts or more;

b. an electrically conductive, generally cylindrical outer shell having an internal electrical contact region;

c. an electrically insulating layer positioned between the single-pole connector and the electrically conductive outer shell; and, d. a generally cylindrical shielding trap configured to provide an electrical connection between a shielding material of a high-power, electrical cable and the internal electrical contact region of the electrically conductive outer shell, wherein the shielding trap further comprises i. a first cylindrical ring having a first shielding contact; and, ii. a second cylindrical ring having a second shielding contact, such that the shielding may be positioned between the first and second shielding contacts and secured in such position by the first and second cylindrical rings.

2. The connector of claim 1, further comprising outer contacts.

3. The connector of claim 1, wherein the first and second cylindrical rings are threaded rings such that the rings may be screwed together to secure the shielding to the shielding trap.

4. A shielded electrical connector, comprising:

a. a single-pole electrical connector;

b. an electrically conductive, generally cylindrical outer shell having an internal electrical contact region;

c. an electrically insulating layer positioned between the single-pole connector and the electrically conductive outer shell; and, d. a generally cylindrical shielding trap configured to provide an electrical connection between a shielding material of a high-power, electrical cable and the internal electrical contact region of the electrically conductive outer shell, wherein the internal electrical contact region is between approximately ¼ and ¾ of one inch in length, and wherein the internal electrical contact region is formed by removing an electrically nonconductive coating from an inner surface of the outer shell.

5. A shielded electrical connector, comprising:

a. a lug-type single-pole electrical connector;

b. an electrically conductive, generally cylindrical outer shell having an internal electrical contact region;

c. an electrically insulating layer positioned between the single-pole connector and the electrically conductive outer shell; and, d. a generally cylindrical shielding trap configured to provide an electrical connection between a shielding material of a high-power, electrical cable and the internal electrical contact region of the electrically conductive outer shell.

6. The connector of claim 5, wherein the lug-type connector may be connected to another contact at variable angles.

7. The connector of claim 5, wherein the electrically insulating layer further comprises a first concentric cylindrical insulating shell and a second concentric cylindrical insulating shell, the first concentric cylindrical insulating shell being positioned over and radially outside of at least a portion of the second concentric cylindrical insulating shell, such that the two shells may be rotated about the lug-type connector together or such that one shell rotates relative to the other shell.

8. The connector of claim 7, wherein the first concentric cylindrical insulating shell has a first oval access hole and the second concentric cylindrical insulating shell has a second oval access hole, and wherein the two access holes may be aligned to provide access to the lug-type connector and may be realigned to provide a complete electrically insulating barrier around the lug-type connector.

9. A high-power shielding trap, comprising:

a. a cylindrical first threaded ring having a first shielding contact;

b. a cylindrical second threaded ring having a second shielding contact, such that a shielding material of a high-power electrical cable may be positioned between the first and second shielding contacts and secured in such position by screwing together the first and second threaded rings; and, c. an outer electrical contact positioned on the outside surface of the shielding trap, wherein the shielding trap is rated for use in an electrical connector rated for currents of 200 amps or more and voltages of 500 volts or more.

10. A shielded electrical connector, comprising:

a. a single-pole electrical connector;

b. an electrically conductive, generally cylindrical outer shell coated with an electrically insulating coating and having an internal electrical contact region wherein there is no electrically insulating coating;

c. an electrically insulating layer positioned between the single-pole connector and the electrically conductive outer shell; and, d. a generally cylindrical shielding trap configured to provide an electrical connection between a shielding material of a high-power, electrical cable and the internal electrical contact region of the electrically conductive outer shell.

* * * * *